US005713799A

United States Patent [19]

Balmat

[11] Patent Number: 5,713,799

[45] Date of Patent: Feb. 3, 1998

[54] GOLF BALL

[76] Inventor: Paul L. Balmat, 5205 Yost Cir., San Diego, Calif. 92109

[21] Appl. No.: 715,933

[22] Filed: Sep. 19, 1996

[51] Int. Cl.[6] ..... A63B 69/36

[52] U.S. Cl. ..... 473/200; 40/327; 40/268; 40/270

[58] Field of Search ..... 473/383, 384, 473/200, 353, 268, 270; 40/327

[56] References Cited

U.S. PATENT DOCUMENTS

| | | | |
|---|---|---|---|
| 676,506 | 6/1901 | Knight . | |
| 2,106,704 | 2/1938 | Davis | 473/384 |
| 2,709,595 | 5/1955 | De Vries | 273/183 |
| 2,728,576 | 12/1955 | Martin et al. | 473/384 |
| 3,325,168 | 6/1967 | Fyanes | 273/186 |
| 4,209,172 | 6/1980 | Yamamoto | 273/183 |
| 4,258,921 | 3/1981 | Worst | 473/383 X |
| 4,441,716 | 4/1984 | Chen | 273/183 |
| 4,546,975 | 10/1985 | Nims | 273/65 |
| 4,603,862 | 8/1986 | Chen | 273/183 |
| 5,067,719 | 11/1991 | Mook | 273/213 |

*Primary Examiner*—George J. Marlo

*Attorney, Agent, or Firm*—Frank G. Morkunas

[57] ABSTRACT

An improved golf ball has navigational band equatorially encircling it over the hall's top, front, bottom, and rear and a non-equatorial alignment band perpendicular to the navigational band midway between the center of the ball and its rear. The respective bands are made of dashed parallel lines subdued but contrasting in color in relation to the color of the ball. At the points of intersection of these bands, two focal points, contrasting from the ball, are formed upon which a golfer, after the ball, the golfer's stance, the club head, and the target have been aligned, focuses attention. A set of directional marks are set within the navigational band and point toward the intended target. The ball is used by aligning the navigational band with the center of the intended target to form a flight path. The club head is then grounded behind the ball in line with the flight path. The golfer uses the club head and the ball as a guide to position his feet in a parallel relationship to the flight path. The golf club head is then positioned directly behind the ball and aligned for squareness with the navigational band by means of the club head alignment band on the back of the ball. Finally, the golfer puts his attention on the focal point of the ball while maintaining the respective alignments and executes his swing or putt.

8 Claims, 2 Drawing Sheets

GOLF BALL

BACKGROUND OF THE INVENTION

This invention relates to a golf ball, specifically to a golf ball structured such that it has imprinted on its surface elements which are intended to be utilized by the golfer as a visual guide to assist the golfer in controlling the direction of flight of a golf ball after it has been hit in a T-shot or in a putting situation.

The elements of the golf ball provide a means for total alignment (navigational alignment, club head alignment, and stance alignment) and orientation as a basis for a relationship between the golfer's standing position, or stance, and the intended flight of the golf ball. The ball also provides a means by which the golfer easily can align the golf club head face so that it is perpendicular to the flight path of the ball—the optimum relation. A final focal point area is created and strategically located on the back center area of the ball to allow the golfer to affix his attention on the ball in such a manner as to facilitate a proper swing, thus propelling the ball towards its intended target.

In the field of golf, the "set up" or "address", which includes the golfer's body positioning and golf club positioning as they relate to the golf ball and the intended target, are the areas that this invention addresses.

A golfer's body alignment (stance), club head alignment, and focus of attention while executing a swing are the foundations upon which a proper golf swing can be built. Before now, alignment and control over direction has been performed by utilizing a sense of feel, or estimating whether a golfer's body and club were truly aligned properly. Slight deviations in proper body positioning (stance) and club head positioning can cause a golf ball to travel far off its intended course after it has been struck. This invention and method of use makes it very simple for a golfer to line up his golf ball with the intended target, to align his feet and body parallel with the flight path of the ball and perpendicular to the target, to square his golf club head face to the optimum location on the golf ball, and to give the golfer a point upon which to focus his attention in such a way as to keep his eye on the back of the ball and keep his head down and steady thereby maintaining all alignments. These actions are all critical in enabling the golfer to control his swing so that the club face impacts the ball in the proper location, thus propelling the ball towards the intended target at an optimum distance and with optimum precision.

A number of attempts have been made to aid the golfer in club head alignment and target alignment with respect to a golf ball club and target. Some of these attempts include patents issued to Knight, Devries, Faynes, Yamamoto, Chen, and Mook. Each of these prior art inventions, though good, fall short of the structural superiority and use associated with the present invention.

U.S. Pat. No. to Knight (676,506) provides a plurality of intersecting lines or stripes around the great circle of the ball which provides a focal point (at point of circumferential intersection) for a golfer to focus his swing and target. In playing the ball, the golfer places one of the intersecting points such that the spot at intersection is just visible at the back of the ball. This will appear to the golfer to be a v-shaped spot at the back of the ball. The v-shaped spot is aligned with the intended target suggesting where and in what direction the ball should be struck.

U.S. Pat. No. to DeVries (2,709,595) describes a ball having a narrow stripe of contrasting color around the ball's middle (great circle or equatorial circle) for use in putting.

This ball is positioned such that the stripe is in line with its intended direction of travel. If a ball is so positioned and is properly putted, the width of the stripe will not increase in appearance as it rolls. If the ball is improperly putted, the apparent width of the stripe will increase in an amount corresponding to the angle of deviation from the line of travel. DeVries further teaches that it is essential that the stripe be relatively narrow in relation to the diameter of the ball or else the illusion of widening will be lost.

U.S. Pat. No. to Faynes (3,325,168) is a training device for driving which includes a ball with diametrically opposed markings on the relative front and back of a ball establishing a diameter through the center of the ball. The ball is of penetrable material and is struck with a club having a protruding needle. The purpose is to strike the ball with the club such that the needle penetrates the respective front and back markings along the established diameter.

U.S. Pat. No. to Yamamoto (4,209,172) discloses a putting training device including a putter and a ball; the ball having two equatorial lines perpendicular to one another encircling the ball with corresponding alignment lines on the putter. The purpose is to align the respective lines and smoothly stroke the ball following that alignment.

U.S. Pat. No. to Chen (4,441,716) discloses a golf ball having grid markings thereon and colored sectional regions on the face of a club to help a golfer determine the exact dimensional orientation of the club face at the moment the ball is struck. The grid bears a marking conveyed by the club after the ball has been struck. Thereby, the golfer can correlate the marked spot with the ball in flight.

U.S. Pat. No. to Moot (5,067,719) discloses a golf ball having three mutually perpendicular equatorial circles; each of a different, primarily, primary color of red, blue, and yellow. At the locations where the circles meet, they do not intersect or overlap, but leave a blank area. The broken circles at these locations point toward each other. The purpose of this ball is to determine the amount and type of spin communicated to the ball after it is struck by color changes detected on the ball in flight and to make corrections to alignment and swing thereby. One of the locations (relative top) is a focal point for a golfer to concentrate when swinging; and another such location (relative back) is the sweet spot where the ball should be struck. The three circles are also used minimally for alignment of the ball to the club and to the target.

It teaches to align the club at the back of the ball on the point of intersection between the horizontal equatorial circle and the other equatorial side-to-side 'polar' circle such that the club is parallel with the side-to-side circle. It also teaches to perpendicularly align the club using the front-to-back 'polar' circle (target line) as an alignment guide. Focus is to be on the focal point on top in the middle of the ball. These lines used for alignment are dark and contrast with the ball. The focal point is the color of the ball. This alignment lines are distracting. Moreover, club alignment is difficult to achieve the further away the alignment line is from the club. It is too far from the club to enable the golfer to achieve and hold proper alignment. The ability to more accurately and tightly align ball to club to target without distraction cannot be achieved with this prior art invention.

Each disclose solid or unbroken stripes or lines around the great circles of the ball (equatorial lines). The target directional lines that are imprinted on the patents to Dervies (2,709,595), Yamamoto (4,209,172), and Nims (4,546,975) are only as accurate as their relationship to a perpendicular club face alignment line. The target directional lines (navigational means) become visually distorted when the golfer moves from behind the ball, where he lines the ball's target directional line with the intended direction of flight to the feet stance position (which should be parallel with the flight path). The distortion of these directional lines is created by (1) the angle of sight, (2) distance to ball, and (3) the golfer's dominant eye vision, which is either left-eye or right-eye dominant. As a result, the target lines or arrows on a ball associated with these prior patents will not appear to be aimed in the proper direction.

The present invention overcomes this problem. The dashed or broken line concept of this invention enables the golfer to take his attention off the flight path directional lines (navigational means) while simultaneously maintaining an accurate flight path direction to the intended target. Other prior art inventions relating to alignment lines, such as the one depicted by Knight (676,506) and Mook (5,067,719), have complex combinations of multi-colored stripes and structural configurations that become visually distracting and confusing to the golfer.

Additionally, in Yamamoto (4,209,172) and Mook (5,067,719), club face alignment lines or arrows are situated on or around the great equator(s) of the ball in a perpendicular relationship to the flight path alignment lines (navigational means). This concept is intended to enable the golfer to position his club head face at an angle 90 degrees to the intended flight path and thereby enable his club face to impact the ball squarely on the preferred position of the ball so as to propel the ball in the intended direction. Because of the angles associated with a golfer's vision in relation to the ball when viewing these lines, the intent is not fully realized while executing a swing.

This concept and its associated intent has been realized by the current invention by placing the club head alignment lines approximately 50% closer to the back of the ball as is illustrated in the drawings. The golfer's ability to truly align his club head face with the flight path at a perpendicular relationship is enhanced by 100%. This club head alignment accuracy is critical since a 1 or 2 degree variation in club head alignment can cause a struck golf ball to travel considerably off its intended course.

Prior art inventions to Knight (676,506) and Mook (5,067,719) further disclose patterns or areas of imprinted design that are to be used as focal points upon which the golfer may focus his attention. Mook's focal point is at the top of the center of the ball and consists of a white area amidst a series of multi-colored arrows. Knight (676,506) also relies on a white area amidst a plurality of colored lines and patterns as its focal point. By such configurations, the golfer's eye is distracted by the collection of bold colored arrows, stripes, and lines. As a result, it is very difficult for the golfer to concentrate on the intended focal point. For a proper golf strike (putt or drive) the golfer's attention should be focused on the back section of the center of the ball; the area that will be impacted by the club head, not on the top of the ball which distorts the intended impact point and thereby distracts attention from the swing.

The present invention has a focal point located at the back center of the ball, and is structured in such a way as to be the most obvious marking on the ball. The dashed line concept of the navigational means and the club head alignment means (i.e., subdued) enhances the visual domination of the focal points. Just before actuating a golf swing, and all alignments (stance, navigational, and club head) have been established, a golfer must remain undistracted and only focused on the back center of the ball. This action facilitates a more controlled and accurate golf swing. Any distractions only act to undermine the efficacy of the swing.

SUMMARY OF THE INVENTION

The above-noted problems, among others, are overcome by the present invention which relates to a golf ball and its method of use, more specifically to a golf ball having club head alignment and target alignment structures. The ball has a target pole, to be pointed in the direction of the intended target, and a club head pole diametrically opposed to the target pole to be pointed toward and perpendicular to the target pole. A non-solid equatorial directional band made of two dashed lines encircles the ball over the first navigational hemisphere (top) and the second navigational hemisphere (bottom), transversing the target pole and the club head pole, and has a visible directional mark pointing toward the target pole. This directional band is to be perpendicularly aligned with the intended target and the golfer's club head face. A non-solid non-equatorial alignment band made up of two dashed lines, parallel to one another and perpendicular to the directional band, is located on the surface of the ball about midway from the club head pole and the center of the ball; a distance equal to about one-half the radius. The golfer aligns his club head face parallel to the alignment band and perpendicular to and centered on the directional band. Two focal points formed at the intersections of the directional band and the alignment band provide focal attention for the golfer after the ball, club, and target are aligned with the directional band and the alignment band and the golfer's feet aligned with the flight path. By focusing attention on the focal point, after these alignments have been made, the golfer eliminates all distractions and can execute a more perfect drive or putt.

BRIEF DESCRIPTION OF THE DRAWING FIGURES

DETAILED DESCRIPTION OF THE PREFERRED EMBODIMENTS

Figure 1:
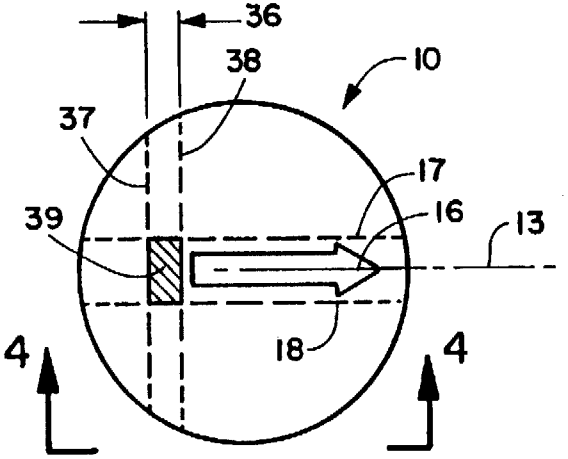
FIG. 1 is a top plan view of the ball.
Figure 2:
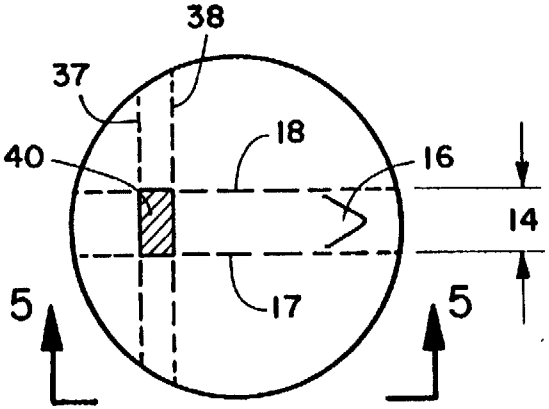
FIG. 2 shows the bottom of the ball taken on view line 2—2 of FIG. 4.
Figure 3:
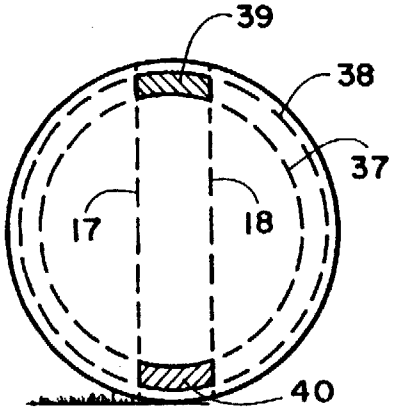
FIG. 3 is an elevation back view of the ball taken on view line 3—3 of FIG. 4.
Figure 4:
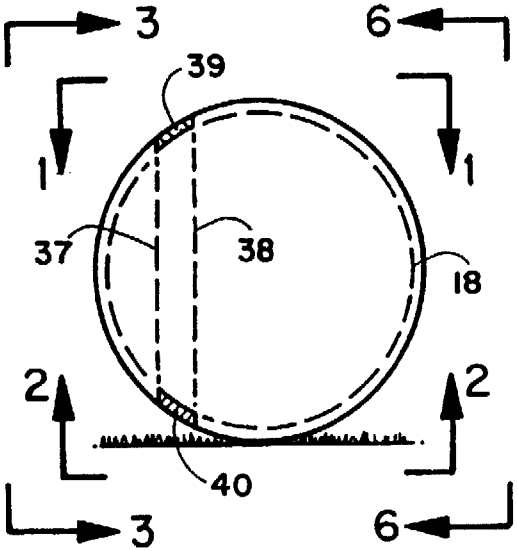
FIG. 4 is an elevation right side view of the ball taken on view line 4—4 of FIG. 1.
Figure 5:
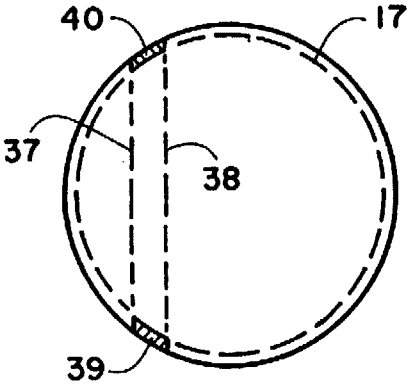
FIG. 5 is an elevation left side view of the ball taken on view line 5—5 of FIG. 2.
Figure 6:
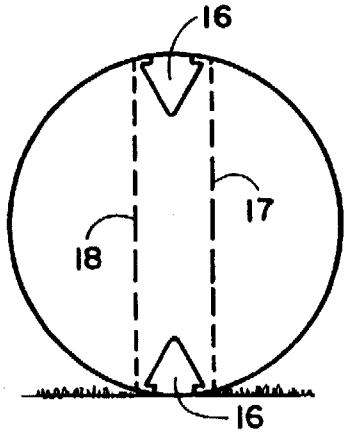
FIG. 6 is an elevation front view of the ball taken on view line 6—6 of FIG. 4.

For clarity golf ball 10 shown in the figures does not show the dimples associated with and part of golf balls. In addition, the ball and its structure are not in all cases drawn to scale. Referring now to FIGS. 1 through 8, ball 10 has a geometric center 12 through which navigational pole axis (vertical) 20 and club head pole axis (horizontal) 30, perpendicular to each other, pass establishing first navigational pole (top) 22, second navigational pole (bottom) 24, target pole (front) 32, and club head pole (back) 34. Hemispheres established thereby include first navigational hemisphere (northern or top half hemisphere) 27, second navigational hemisphere (southern or bottom half hemisphere) 29, club hemisphere (western or left half hemisphere) 28, and target hemisphere (eastern or right half hemisphere) 26.

An equatorial band longitudinally encircling ball 10 intersecting the respective poles 22, 24, 32, and 34 establishes an imaginary navigational center line 13 about which navigational means 14 is formed. Navigational means 14 comprises a band having a first directional line 17 and a second directional line 18 substantially parallel to one another and each substantially equidistant from the navigational center line 13. This band about navigational means 14 is formed to be non-obtrusive. It is specifically structure in a substantially diffused state which may be made of broken lines, dashed lines, plurality of dots, and similar configurations. The preferred, and shown embodiment, consists of dashes forming dashed lines. The width of the band so formed can range from approximately ⅛" to approximately ⅜". The most effective width has been found to be approximately ¼" to 5/16".

Directional marks 16 lie within navigational means in target hemisphere 26 in first navigational hemisphere 27 and in second navigational hemisphere 29 communicating in the direction of target pole 32. Directional marks 16 may be an arrow, a pointer, a straight line, or any similar pointing or directional marking such that the point or the pointer is centered in navigational means 14 on the navigational center line. In the preferred embodiment, a pointer resembling a horizontal "v" ('>') forms the directional mark.

As described above, navigational means 14 is intentionally structured so as not to be distracting to a golfer when executing a swing. It generally consists of the band formed by the broken markings forming the two directional lines around navigational center line 13. It also may be subdued in color in relation to the color of the ball or it may be contrasting in color. The greater the contrast, however, the more distracting the navigational means and the less effective the invention. The preferred embodiment provides for a non-contrasting navigational means.

Club head alignment means 36 is a band formed by first alignment line 37 and second alignment line 38 which are substantially parallel to each other and substantially perpendicular to, navigational means 14. Similar to the band formed by navigational means 14, club head alignment means 36 may be formed of any means as was navigational means. In the preferred embodiment, club head alignment means 36 is subdued in nature similar in structure as is navigational means 14 (without the directional mark). First and second alignment lines 37 and 38 are substantially broken lines such as lines formed by using dashes or dots. Dashes is the preferred mode. Second alignment line 38 is substantially midway between navigational pole axis 20 and club head pole 34 in club hemisphere 28 (or ½ the radius [midway between center 12 and club head pole 34 as shown by reference character 31 of FIG. 7]). First alignment line 37 is substantially proximal to club head pole 34.

The width of club head alignment band 36 so formed can range from approximately 3/64" to approximately 7/64". The most effective width has been found to be approximately ⅛" to 3/16". Club head alignment means 36 intersects navigational means 14 at two locations; both in club hemisphere 28 with one in first navigational hemisphere 27 and the other in second navigational hemisphere 29. First focal point 39 and second focal point 40 are formed at these intersections. The focal points preferably are contrasted from the rest of ball 10 and become the focus of attention for the golfer after he has aligned ball 10 to his club face 42 and the intended target (shown as the golf hole for this purpose as reference 48 of FIG. 9) before he executes his swing. In the preferred embodiment, focal points 39 and 40 are substantially black.

Turning now to the method of using ball 10 as described above. Ball 10 is placed on surface means 49 (tee, on the green, or similar surface) with club head pole axis 30 substantially parallel to the surface and with target pole 32 pointing in the direction of target 48 such that directional marker 16 is substantially centered with the center of target 48. This forms an imaginary line referred to as flight path 50. This alignment may be done in any manner but it is preferable that the golfer position himself substantially behind the ball and facing the intended target.

From this alignment, flight path 50 bisects navigational means 14 and later will be used to align the center of club face 45. In other words, when properly aligned, center of club face 45, navigational center line 13, center of target 48 form a substantially straight line now referred to as flight (or club) path 50. Also from this positioning of ball 10, a golfer can see directional mark 16, first focal point 39, and that portion of club head alignment means 36 in first navigational hemisphere 27.

Figure 9:
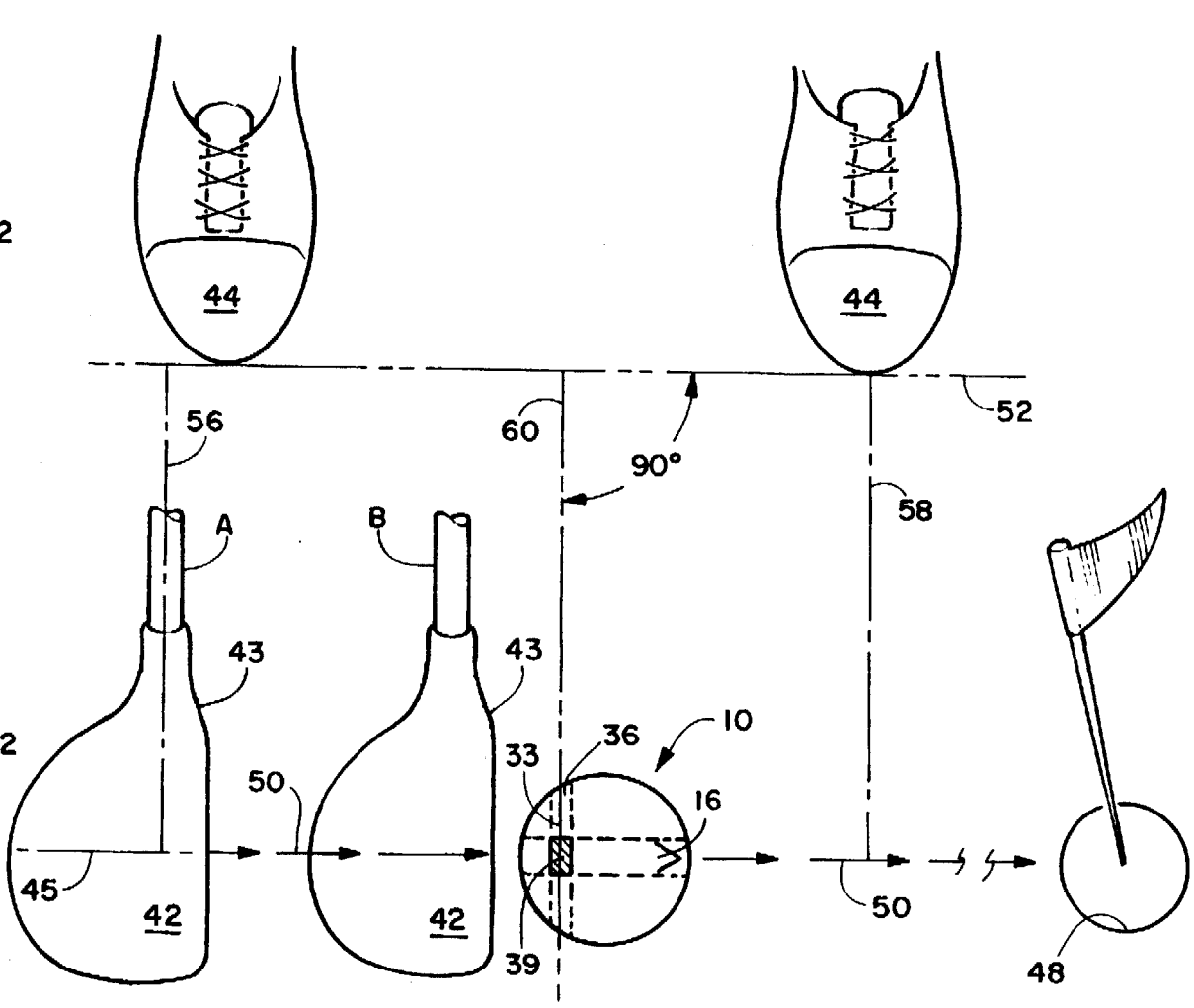
FIG. 9 depicts the method of using the ball.
Figure 7:
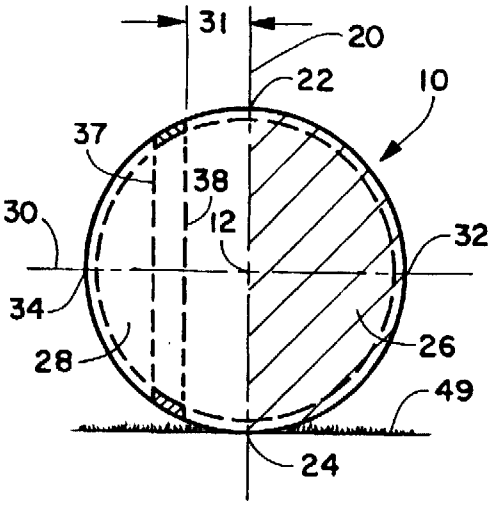
FIG. 7 is an elevation right side view of the ball depicting its vertical hemispheres.
Figure 8:
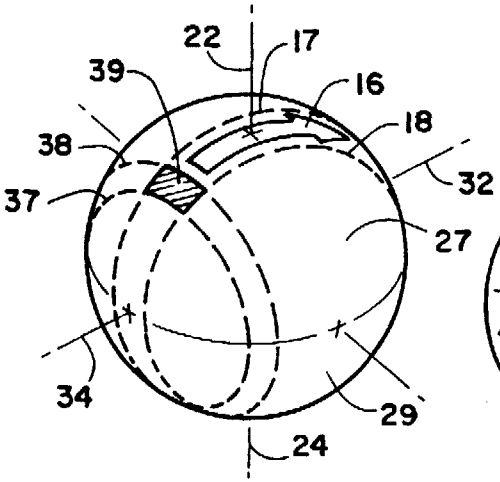
FIG. 8 is a perspective view of the ball depicting its horizontal hemispheres.

The golfer next grounds club 42 by placing it substantially adjacent to ball 10 at a distance of about 12" to 30" behind ball 10 (position A as seen in FIG. 9); 18" to 20" is preferred. The golfer centers club center line 45 with navigational center line 13 and center of target 48 thereby extending flight path 50.

While still grounding club 42 in this aligned position, the golfer positions himself for the proper stance. Golfer's feet 44 are spread and, from foot to foot, form an imaginary stance line 52. Stance line 52 must be substantially parallel to flight path line 50 and, concomitantly, parallel to navigational means 14 and, as will be seen, perpendicular club head face 43 and club head alignment means 36. To do this, golfer uses ball 10 and club 42, which are aligned, and plants his feet substantially parallel thereto from where he will execute his swing.

Club line 60 is an imaginary line extending substantially to club head alignment means 36. In his stance, golfer 44 places one foot substantially adjacent to first stance line 56 and substantially parallel to stance line 52. Golfer 44 places the other foot substantially adjacent to second stance line 58 and substantially parallel to stance line 52.

The golfer next moves club 42 from position A substantially to position B. Club face 43 is next aligned such that it is substantially parallel to club head face alignment means 36 and perpendicular to flight path 50 and, concomitantly, with navigational center line 13 and navigational means 14. Shape, width, and location of club head alignment means 36 make aligning club face 43 with club head alignment means 36 relatively quick and simple.

The golfer then grips club 42 for the swing or putt about to be made. With all points in synchronous alignment, the golfer now focuses his attention on first focal point 39 or second focal point 40 (as the case may be). The respective focal points being on navigational means 14 and club head alignment means 36, assists the golfer in maintaining his pre-set full alignments (stance, navigational, and club head) for the duration of the swing or putt. There are no distractions such as generally caused by centered focal points, marked contrasting stripes, multiple points or marks, or multiple colors; there is but one focal point near to the point of impending impact upon which to concentrate. The subdued nature of the navigational means 14 and club head alignment means 36 permits each to fade from conscious view.

While maintaining focal contact with the respective focal point (39 or 40) and maintaining full alignments previously made, the golfer then executes his swing. Following this method for and using this invention will enable a golfer to make better more accurate putts more in line with the intended path of the ball and to execute better and more accurate drives more in keeping with the intended flight path.

While a specific embodiment has been shown and fully explained above for the purpose of illustration, it should be understood that many other uses will be found for the instant invention disclosure and many alterations, modifications, and substitutions may be made thereto without departing from the spirit and scope of the invention as defined by the appended claims. Such are intended to be included within the scope of the invention. Accordingly, the scope of the invention should be determined not by the embodiment[s] illustrated, but by the appended claims and their legal equivalents.

The invention claimed is:

1. An improved golf ball having a center 12 with a navigational pole axis 20 and a club head pole axis 30 intersecting at said center 12 and being perpendicular to one another, said ball comprising:

a. a target pole 32 on one end of said club head pole axis 30 and a club head pole 34 on an opposite end of said club head pole axis 30;

b. a first navigational pole 22 on one end of said navigational pole axis 20 establishing a first navigational hemisphere 27 to said center, and a second navigational pole 24 on an opposite end of said navigational pole axis 20 establishing a second navigational hemisphere 29 to said center;

c. navigational means 14 comprising a navigational band encircling said ball intersecting said first navigational pole 22, said target pole 32, said second navigational pole 24, and said club head pole 34 thereby forming an equatorial circle;

d. club head alignment means 36 substantially perpendicular to said navigational means 14 defining a circular path comprising at least two substantially parallel interrupted alignment lines, said circular path at a point substantially equidistant between said navigational pole axis 20 and said club head pole 34; and said alignment lines being of a color subdued but contrasting in relation to the color of the ball.

2. The invention as described in claim 1 wherein said navigational band comprises at least two substantially parallel interrupted directional lines, said lines being a first directional line 17 and a second directional line 18 each of said directional lines further being substantially equidistant from said equatorial circle.

3. The invention as described in claim 2 wherein said directional lines are comprised of dashes forming substantially subdued dashed lines.

4. The invention as described in claim 2 wherein said directional lines are of a color subdued but contrasting in color in relation to the color of the ball.

5. The invention as described in claim 1 wherein said alignment lines are comprised of dashes forming substantially subdued dashed lines.

6. The invention as described in claim 1 further having a directional mark 16 within said navigational means 14 located substantially between said navigational axis 20 and said target pole 32 and in, and visible from, said first navigational hemisphere 27 and from said second navigational hemisphere 29, said directional mark further communicating in the direction of said target pole.

7. The invention as described in claim 1 further having a focal point 39 where said club head alignment means 36 intersects said navigational means 14, said focal point substantially contrasted from said club head alignment means and said navigational means.

8. An improved golf ball having a center 12 with a navigational pole axis 20 and a club head pole axis 30 intersecting at said center and being perpendicular to one another, said ball comprising:

a. a target pole 32 on one end of said club head pole axis 30 and a club head pole 34 on an opposite end of said club head pole axis 30;

b. a first navigational pole 22 on one end of said navigational pole axis 20 establishing a first navigational hemisphere 27 to said center, and a second navigational pole 24 on an opposite end of said navigational pole axis 20 establishing a second navigational hemisphere 29 to said center;

c. navigational means 14 comprising navigational band encircling said ball intersecting said first navigational pole 22, said target pole 32, said second navigational pole 24, and said club head pole 34 thereby forming an equatorial circle, said navigational band having at least two substantially parallel interrupted directional lines;

d. club head alignment means 36 substantially perpendicular to said navigational means 14 defining a circular path comprising at least two substantially parallel interrupted alignment lines, said circular path at a point substantially equidistant between said navigational pole axis 20 and said club head pole 34;

e. a focal point 39 where said club head alignment means 36 intersects said navigational means 14, said focal point substantially contrasted from said club head alignment means and said navigational means; and said directional lines and alignment lines being of a color subdued but contrasting in relation to the color of the ball.

* * * * *